US005180422A

United States Patent [19]

Kikumoto et al.

[11] Patent Number: 5,180,422

[45] Date of Patent: Jan. 19, 1993

[54] COPPER SMELTING PROCESS

[75] Inventors: Nobuo Kikumoto, Tokyo; Mineo Hayashi, Kagawa, both of Japan

[73] Assignee: Mitsubishi Materials Corporation, Tokyo, Japan

[21] Appl. No.: 795,343

[22] Filed: Nov. 20, 1991

[30] Foreign Application Priority Data

Nov. 20, 1990 [JP] Japan ..... 2-314672

[51] Int. Cl.[5] ..... C22B 15/00

[52] U.S. Cl. ..... 75/644; 75/641; 75/643

[58] Field of Search ..... 75/643, 641, 644

[56] References Cited

U.S. PATENT DOCUMENTS 2,111,789 3/1938 Kuzell ..... 75/643

2,129,760 9/1938 Greenawalt ..... 75/643

3,281,236 10/1966 Meissner ..... 75/643

3,857,701 12/1974 Hunter ..... 75/641

*Primary Examiner*—Peter D. Rosenberg

*Attorney, Agent, or Firm*—Oblon, Spivak, McClelland, Maier & Neustadt

[57] ABSTRACT

A copper smelting process is disclosed in which copper concentrate is smelted in a furnace to produce purified copper. Flue gas discharged from the furnace is treated to produce sulfuric acid. Furthermore, waste liquid discharged during the production of sulfuric acid is treated to produce gypsum, and the gypsum thus produced is recycled to the furnace as a flux. The flue gas may be exhausted from either or both of a smelting furnace and a converting furnace, and the gypsum may be preferably introduced into the converting furnace.

4 Claims, 3 Drawing Sheets

COPPER SMELTING PROCESS

BACKGROUND OF THE INVENTION

1. Field of the Invention

The present invention relates to a process for smelting copper sulfide concentrates to extract blister copper.

2. Prior Art

As schematically depicted in FIG. 1, a continuous copper smelting apparatus comprised of a plurality of furnaces is hitherto known. The continuous smelting apparatus comprises three furnaces connected in series through launders 7 for flowing melt therethrough. Copper concentrates are smelted in a smelting furnace 1 and transported through the launder 7 to a separating furnace 2, where the melt is separated into immiscible upper and lower layers of slag S and matte M, respectively. The matte M, which contains copper as the main constituent, is siphoned out from the separating furnace 2 and transferred to the converting furnace 3 through the launder 7. In the converting furnace 3, iron sulfide and subsequently sulfur are removed by oxidation from the matte M, and blister copper C is obtained.

In each of the smelting furnace 1 and the converting furnace 3, lances 5, each having a double-pipe structure, are inserted through the furnace roof and attached thereto for vertical movement. Copper concentrates, oxygen-enriched air, flux, cold charge and so on are supplied into each furnace through the lances 5. The separating furnace 2 is an electric furnace, which is equipped with electrodes 6.

The blister copper C produced continuously in the converting furnace 3 is stored temporarily in a holding furnace 8, and then received in a ladle 9 which is conveyed by means of a crane 10 to the anode furnaces 4, and the blister copper C is poured thereinto through the inlet formed in the top wall. In the anode furnaces 4, the blister copper C is further oxidized and reduced into copper of greater purity, which is then cast into anode plates and is subjected to electro-refining.

In the smelting furnace 1 and the converting furnace 3, the fluxes supplied through the lances 5 help the formation of a fluid slag of an appropriate viscosity, which absorbs FeO or the like produced in the furnace to thereby improve smelting efficiency.

The slag S discharged from the separating furnace 2 is solidified, granulated, and used as cement filler material, subgrade materials or the like; whereas, as shown in FIG. 2, the slag discharged from the converting furnace 3, which contains a high proportion of calcium, is recycled to the smelting furnace 1.

The off-gases, exhausted from the smelting furnace 1 and the converting furnace 3, respectively, contain sulfur dioxide of a high gas strength, and in an acid plant 11, the sulfur dioxide is absorbed by water to produce sulfuric acid. Furthermore, in the waste liquid treatment in the acid plant, gypsum ($CaSO_4.2H_2O$) is inevitably produced.

Thus, in the aforesaid copper smelting process, gypsum is produced in a predetermined proportion to the production of blister copper. Therefore, when gypsum is in low demand, the smelting process incurs high cost, and a large amount of gypsum must be disposed of.

SUMMARY OF THE INVENTION

It is therefore a principal object and feature of the present invention to provide a novel copper smelting process which does not require the disposal of gypsum, thereby substantially reducing the operating costs.

Another object and feature of the invention is to provide a copper smelting process which can recycle the gypsum while maintaining the quality of the blister copper.

According to the invention, there is provided a copper smelting process comprising the steps of:

smelting copper concentrate in a furnace to produce purified copper;

treating flue gas discharged from the furnace to produce sulfuric acid;

treating waste liquid discharged during the production of the sulfuric acid to produce gypsum; and introducing the gypsum into the furnace as a flux.

In the foregoing, the smelting step may include introducing the copper concentrate in a smelting furnace to produce a mixture of matte and slag, subsequently receiving the mixture of matte and slag in a separating furnace to separate the matte from the slag, and subsequently receiving the matte separated from the slag in a converting furnace to oxidize the same into blister copper. The flue gas exhausted from either or both of the smelting furnace and the converting furnace may be used to produce the sulfuric acid, and the gypsum may be preferably introduced into the converting furnace.

The gypsum, which is produced in the waste liquid treatment and introduced into the converting furnace, contains an elevated amount of sulfur. However, the sulfur should be removed as a component of the flue gas during the operation in the converting furnace. Therefore, the recycling of the gypsum in the converting furnace does not adversely affect the desulfurization of the matte in the converting furnace, so that the quality of the blister copper can be maintained.

DESCRIPTION OF PREFERRED EMBODIMENTS OF THE INVENTION

Figure 1:
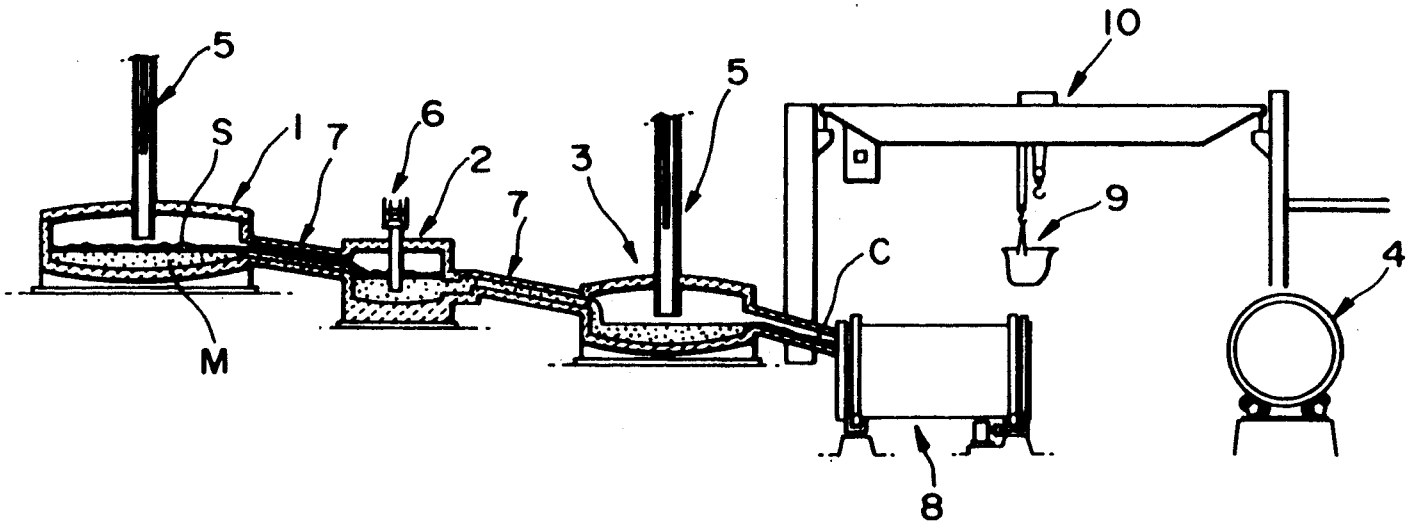
FIG. 1 is a schematic cross-sectional view of a continuous copper smelting apparatus used conventionally.
Figure 2:
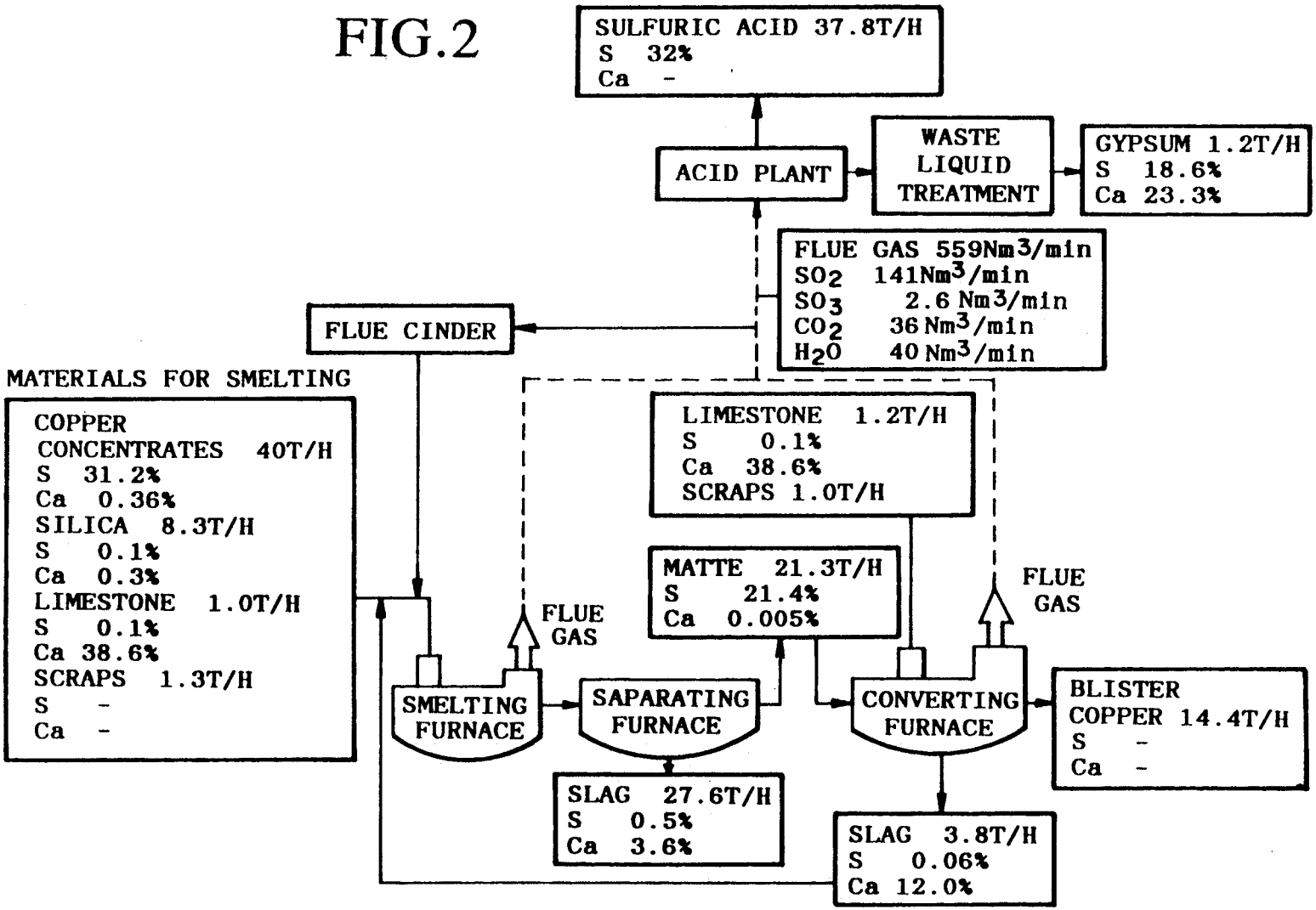
FIG. 2 is a flow diagram showing a conventional copper smelting process.
Figure 3:
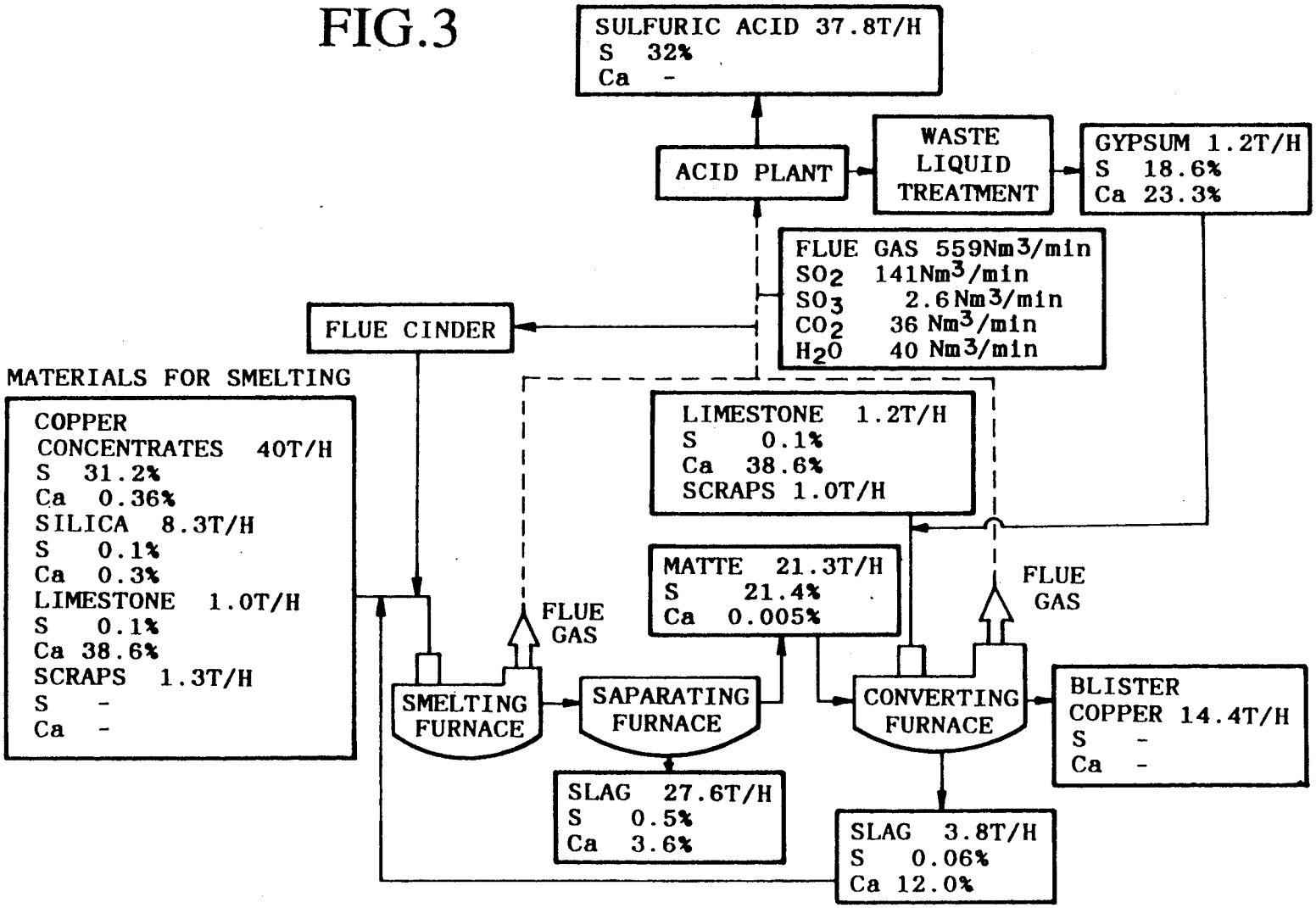
FIG. 3 is a view similar to FIG. 2, but showing a continuous copper smelting process in accordance with the present invention.

In FIG. 3, which depicts an embodiment of a continuous copper smelting process in accordance with the invention, the material balances of sulfur and calcium during the smelting operations are shown. The process in accordance with the present invention will be hereinafter explained while comparing it with the prior art process depicted in FIG. 2.

The throughput and analyzed compositions shown in the flow diagrams of both processes are average values taken during a two-week operation. A sufficient time interval was given between the operation of the process of the invention and that of the prior art process, lest the latter operation be affected by the previous operation. In addition, the operating conditions were identically maintained except for the recycling of gypsum. Furthermore, those weights which are represented by "T/H" are all dry weights, and "%" denotes "% by weight".

In the smelting furnace 1, copper concentrates, flue cinders (dust in the off-gases from the smelting furnace and the converting furnace), and granulated scraps were fed as a source of copper, while silica and limestone were fed as fluxes. Further, granulated slag produced in the converting furnace 3 was also supplied.

In the prior art operation of the converting furnace 3, limestone of the same amount as in the smelting furnace 1 was supplied thereinto together with granulated scraps.

In contrast, in the operation according to the process of the invention, gypsum, which was produced in the waste liquid treatment in the sulfuric acid producing process, was introduced into the converting furnace 3, and the gypsum thus introduced was substituted for a part of the limestone to be supplied into the converting furnace 3. The amount of the substitution was determined such that the total supply of calcium was unchanged compared with the prior art operation.

The off-gases discharged from the smelting furnace 1 and the converting furnace 3 contained 25% by volume of $SO_2$ and little $SO_3$, and the sulfuric acid was obtained by treating these off-gases in an acid plant 11. In the prior art operation, the throughput of gypsum amounted to about 60% of the limestone to be fed into the converting furnace 3; and in the illustrated embodiment of the invention, all of the gypsum thus produced was fed into the converting furnace 3, and limestone was also used to make up for the deficiency.

In the operation according to the invention, the gypsum was introduced into the converting furnace 3 as a flux, and hence the amount of sulfur was increased. However, even though the smelting operation was carried out under the same conditions as in the prior art operation, the sulfur content in the blister copper produced in the converting furnace 3 remained unchanged, and no deterioration of the copper quality was observed. Furthermore, no increase of sulfur content in the slag tapped from the converting furnace 3 was found, and hence there was no problems in recycling the slag S to the smelting furnace 1.

The increase of sulfur only resulted in the increase of the sulfur content in the off-gases. Therefore, although the throughput of the sulfuric acid was increased, no difference was recognized as to the throughput of gypsum.

The reason why the gypsum did not affect the composition of the blister copper would be that at the high temperature found in the furnace, the equilibrium for the following chemical reaction proceeded in the right direction.

$$CaSO_4 \rightarrow CaO + SO_2 \uparrow + \tfrac{1}{2}O_2 \uparrow .$$

Obviously many modifications and variations of the present invention are possible in the light of the above teachings. For example, although the preferred embodiment has been explained for the continuous copper smelting process, the invention may be practiced with a conventional copper smelting process as well.

What is claimed is:

1. A copper smelting process comprising the steps of:

smelting copper concentrate in a furnace to produce copper;

treating flue gas discharged from said furnace to produce sulfuric acid;

treating waste liquid discharged during the production of the sulfuric acid to produce gypsum; and introducing said gypsum into said furnace as a flux.

2. A copper smelting process as recited in claim 1, wherein said smelting step includes:

introducing the copper concentrate in a smelting furnace to melt and oxidize the same to produce a mixture of matte and slag;

subsequently receiving said mixture of matte and slag in a separating furnace to separate the matte from the slag; and subsequently receiving said matte separated from the slag in a converting furnace to oxidize the same to produce blister copper.

3. A copper smelting process as recited in claim 2, wherein said flue gas exhausted from at least one of said smelting furnace and said converting furnace is used to produce sulfuric acid in said flue gas treating step.

4. A copper smelting process as recited in claim 3, wherein in said gypsum introducing step, the gypsum is introduced into said converting furnace.

* * * * *